US007004089B2

(12) United States Patent
Dernjatin et al.

(10) Patent No.: US 7,004,089 B2
(45) Date of Patent: Feb. 28, 2006

(54) COMBINED FLUIDIZED BED AND PULVERIZED COAL COMBUSTION METHOD

(75) Inventors: Pauli Dernjatin, Helsinki (FI); Kati Savolainen, Vantaa (FI); Kari Jääskeläinen, Vantaa (FI); Marko Fabritius, Helsinki (FI)

(73) Assignee: Kvaerner Power Oy, Tamperem (FI)

( * ) Notice: Subject to any disclaimer, the term of this patent is extended or adjusted under 35 U.S.C. 154(b) by 178 days.

(21) Appl. No.: 10/476,684

(22) PCT Filed: May 11, 2001

(86) PCT No.: PCT/FI01/00459

§ 371 (c)(1),
(2), (4) Date: Dec. 8, 2003

(87) PCT Pub. No.: WO02/093074

PCT Pub. Date: Nov. 21, 2002

(65) Prior Publication Data

US 2004/0261675 A1 Dec. 30, 2004

(51) Int. Cl.
*F23G 5/30* (2006.01)
*F23D 1/00* (2006.01)

(52) U.S. Cl. ..... 110/245; 110/347

(58) Field of Classification Search ..... 110/243, 110/244, 245, 347, 261, 263
See application file for complete search history.

(56) References Cited

U.S. PATENT DOCUMENTS

| | | | | |
|---|---|---|---|---|
| 4,421,036 A | | 12/1983 | Brannstrom et al. | |
| 4,993,332 A | | 2/1991 | Boross et al. | |
| 5,190,451 A | * | 3/1993 | Goldbach | 431/5 |
| 5,396,849 A | * | 3/1995 | Boyd | 110/342 |

FOREIGN PATENT DOCUMENTS

| | | |
|---|---|---|
| DE | 44 09 057 A1 | 9/1995 |
| GB | 2 192 141 A | 1/1988 |
| WO | WO 97/39280 A1 | 10/1997 |

* cited by examiner

*Primary Examiner*—Kenneth Rinehart
(74) *Attorney, Agent, or Firm*—Birch, Stewart, Kolasch & Birch, LLP

(57) ABSTRACT

The invention relates to a combined fluidized bed and pulverized coal combustion method and system. In the method, fluidizing air (4) is injected into a fluidized bed (2) situated in the bottom portion of the combustion chamber (3). Into the combustion chamber, to above the fluidized bed (2), is fed a mixture of pulverized coal and a carrier gas from a second set of fuel feed means (6) at a mass flow rate which is higher or at least substantially equal to the upper ignition limit of the mixture, and the mixture of the pulverized coal and the carrier gas at least by the fluidizing air (4), and at least a fraction of the fuel fed via the second set of fuel feed means (6) is combusted above the fluidized bed (2).

18 Claims, 3 Drawing Sheets

COMBINED FLUIDIZED BED AND PULVERIZED COAL COMBUSTION METHOD

This application is the national phase under 35 U.S.C. § 371 of PCT International Application No. PCT/FI01/00459 which has an International filing date of May 11, 2001, which designated the United States of America.

The invention relates to a combined fluidized bed and pulverized coal combustion method according to the preamble of claim 1, in which method fluidizing air is injected into a fluidized bed residing in the bottom portion of a combustion chamber, fuel is fed from a first set of fuel feed means into the fluidized bed and is burnt in the fluidized bed, and the mixture of pulverized coal and a carrier gas is fed from a second set of fuel feed means into the combustion chamber, to above the fluidized bed.

The invention also relates to a system for implementing the method.

In firing by pulverized coal, the pulverized coal and the combustion air are mixed with each other in a burner. To obtain an efficient ignition and combustion of the mixture of coal and combustion air introduced from a burner into the combustion chamber of a boiler, these two must have a suitable fuel/air ratio. The mixture does not ignite at all if the mass flow rate ratio of coal to combustion air is below a certain lower ignition limit. In firing by pulverized coal, the lower ignition limit is typically about 0.2. When the fuel/air ratio is in the range 0.2 to 0.4, the mixture will ignite but due to the lean mixture, the flame remains unstable and the combustion temperature low. The generally used fuel/air ratio in firing by pulverized coal is about 0.4, whereby the flame is stable and the mixture burns at an elevated temperature. A fuel/air ratio higher than this up to a certain upper ignition limit gives good ignition but due to the rich mixture renders a low combustion temperature. In firing by pulverized coal, the upper ignition limit is typically about 1.0. Mixtures richer than this cannot be ignited anymore.

In fluidized bed combustion, the fuel burns and becomes partially gasified in a fluidized bed which resides above an air distributor located in the bottom portion of the combustion chamber of the boiler and is formed by particulate matter bed material and the fuel mixed therewith. Conventionally, the bed material is sand. The bed is maintained in a fluidized state by way of injecting fluidizing gas, generally air, into the bed from nozzles located in the air distributor. As the velocity of the fluidizing air is low in the bed and a coarse particle size is selected for the bed material, the fluidized bed is consequently formed in the bottom portion of the combustion chamber. The solid fuel is generally fed into the fluidized bed boiler via fuel feed nozzles adapted to the walls of the combustion chamber. The combustion temperature in fluidized bed combustion is typically about 800 to 950° C.

Due to the low combustion temperature and coarse milling of the fuel, fluidized bed combustion of coal has given a relatively low combustion efficiency as compared with many other firing methods. The low combustion temperature also increases the amount of nitrogen oxides formed in the combustion process. If a coarsely milled fuel of high heat value, such as coal, is burnt in a fluidized bed, accumulation of uncombusted fuel in the bottom portion of the fluidized bed takes place, whereby the fuel burning therein elevates the bed temperature and sintering of the bed material occurs. To avoid this, the bed can be cooled by heat exchangers located in the bed. However, the abrasive bed material can rapidly corrode a heat exchanger embedded in the bed. The amount of fuel accumulating in the bottom portion of the fluidized bed can be reduced by way of moving the inlet point of the fuel to above the fluidized bed and/or milling the fuel into a smaller particulate size. The latter operation, however, generally dictates the acquisition of a coal mill of a higher milling efficiency.

In U.S. Pat. No. 4,993,332 is described a hybrid combustion system that combines fluidized bed combustion with pulverized coal combustion, in which system the fluidized bed of a fluidized bed boiler is fired in a conventional manner by coal complemented with firing pulverized coal above the fluidized bed by means of a burner mounted on the boiler wall. The object of this arrangement is to reduce the disadvantages of fluidized bed combustion and pulverized coal combustion.

When a conventional fluidized bed boiler is to be converted suitable for hybrid combustion, the boiler need to be retrofitted with a pulverized coal burner and an efficient coal mill in order to provide the boiler with a coal feed of sufficiently fine and consistent particle size. However, the new burner and efficient coal mill represent a significant cost-increasing factor in retrofitting a hybrid combustion system.

It is an object of the invention to provide an entirely novel fluidized bed combustion method and system capable of improving the combustion efficiency of fluidized bed combustion and reducing nitrogen oxide emissions of fluidized bed combustion.

In an embodiment according to the invention, the fuel is fed in a conventional manner into the fluidized bed of a fluidized bed boiler and is combusted in the bed. Additionally, to above the fluidized bed is admitted pulverized coal through, e.g., a duct adapted to the wall of the combustion chamber, at such a high coal/carrier gas ratio that the fuel will not ignite in the close vicinity of the feed point. The fluidizing air blown upward from the bottom of the bed dilutes the mixture of the pulverized coal and the carrier gas thus allowing the coal particles to ignite and burn in a rich flame pattern above the fluidized bed. While a fraction of the coal can burn above the fluidized bed, the other fraction falls into the fluidized bed and is combusted therein.

More specifically, the fluidized bed combustion method according to the invention is characterized by what is stated in the characterizing part of claim 1.

Furthermore, the fluidized bed combustion system according to the invention is characterized by what is stated in the characterizing part of claim 11.

The invention offers significant benefits.

While the system according to the invention operates generally in the same fashion as the hybrid combustion system described above, but instead, the pulverized coal burner of the prior-art system is replaced by a duct exiting into the combustion chamber. Moreover, herein the fuel to be discharged from the duct need not be milled to such a fineness and homogeneous particle size as in pulverized coal combustion utilizing a burner, thus allowing the system according to the invention to use a simple and cost-efficient coal mill.

A major fraction of the coal fed above the fluidized bed is burnt before the coal falls onto the fluidized bed. A certain fraction of the coal is combusted in the bed, whereby the bed temperature rises slightly thus contributing to the combustion efficiency of the fluidized bed combustion system. However, the bed temperature will not rise so high as to necessitate the use of separate heat exchangers for cooling the bed. The coal combusted above the fluidized bed burns under fuel-rich conditions at a high temperature, whereby above the fluidized bed is created a so-called reburn zone wherein nitrogen oxides formed in the bed are reduced into molecular nitrogen. If a refuse fuel is combusted in the fluidized bed, the combustion process of the bed forms dioxins and other hazardous compounds that also are destroyed at the elevated temperature of the reburn zone. Furthermore, the high temperature of the reburn zone promotes the combustion of coal particles above the fluidized bed, thus improving the combustion efficiency of the boiler.

In the following, the invention is examined in more detail by way of referring to the attached drawings, wherein FIG. 1 is a schematic diagram of an embodiment of a combined fluidized bed and pulverized coal combustion system according to the invention.

Figure 1:
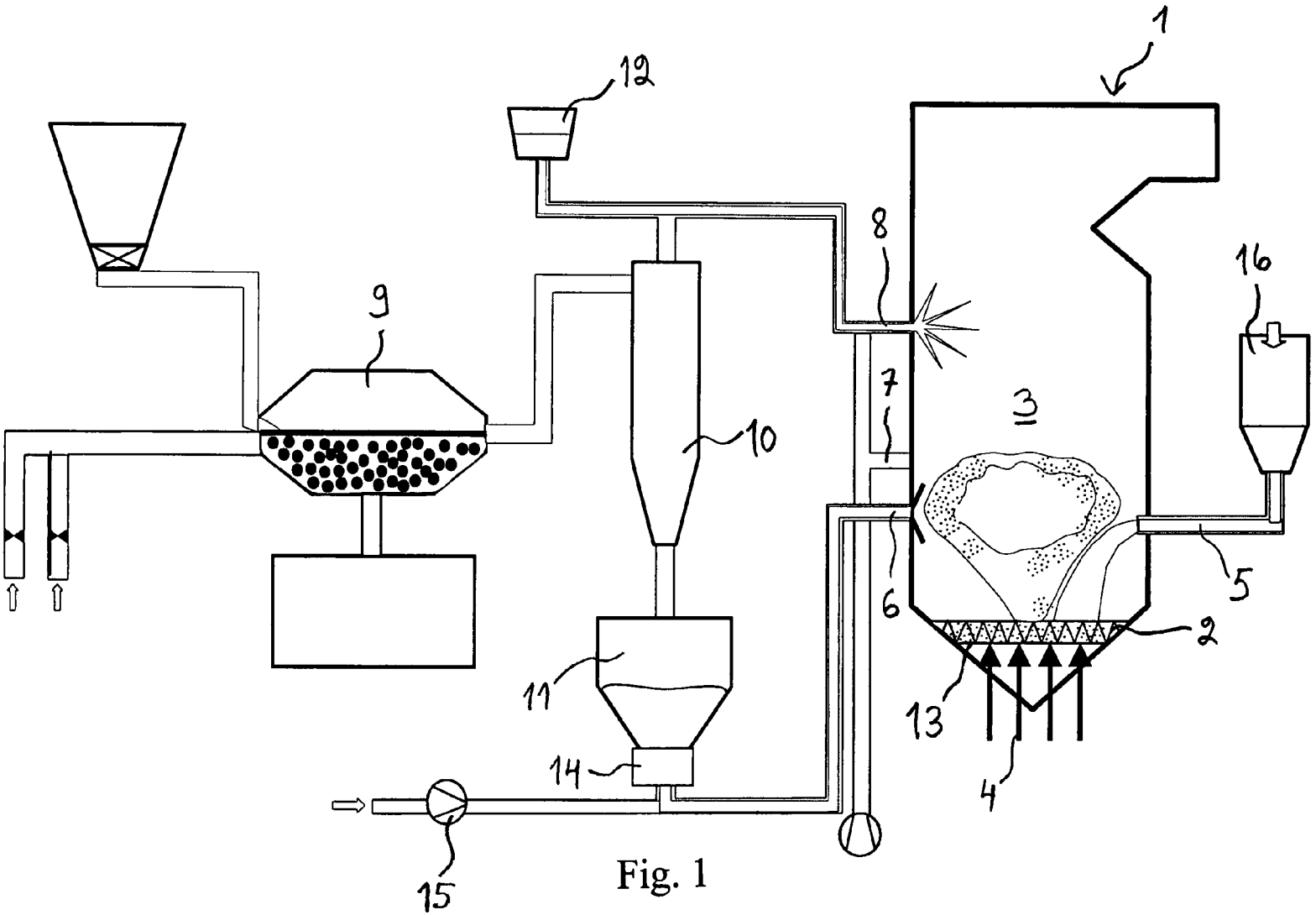

A system illustrated in the drawing comprises a fluidized bed boiler 1 having a fluidized bed 2 of particulate matter situated in the bottom portion of the boiler combustion chamber 3. A grid 13 disposed at the bottom of the combustion chamber 3 includes air feed means for admitting fluidizing air 4 into the bed material. The velocity of the fluidizing air 4 is adjusted to keep the fluidized bed 2 formed in the bottom portion of the combustion chamber 3 in order to avoid a substantial loss of the bed material from the bed along with the gas flow, thus generally disposing with the need for circulating the bed material particles back to the bed 2. This type of fluidized bed is also known as a bubbling fluidized bed. Although a fraction of the bed material particles can rise with the gas flow up to the middle portion of the combustion chamber 3, a bubbling fluidized bed 2 has a clearly discernible top level. The fluidizing air 4 may also be used as the primary combustion air in the combustion chamber 3. Coarse-milled fuel is fed into the fluidized bed 2 in a conventional manner via a first set of fuel feed means 5, such as one or more openings made to the wall of the combustion chamber 3, whereto the fuel is transported by a conveyor from a silo 16. Conventionally, the fuel is coarse-milled coal, peat, biofuel, refuse fuel or a mixture of these.

Into the combustion chamber 3 is also fed pulverized coal via a second set of fuel feed means located above the fluidized bed 2, such as a duct 6 exiting into the combustion chamber 3. In its simplest form, the duct 6 can be a pipe exiting into the combustion chamber with a diameter of 150–300 mm. Also a multiple number of ducts 6 can be used. The coal is ground in a coal mill 9 and the coal comminuted into pulverized form is transported pneumatically via a cyclone 10 to a coal storage 11, wherefrom it is moved with the help of a screw conveyor 14, for instance, to the duct 6. The carrier gas of the pulverized coal is pressurized by means of a compressor 15, thus effecting the pneumatic discharge of the pulverized coal from the duct 6 into the combustion chamber 3. Advantageously, the carrier gas is air. Alternatively, the carrier gas may be flue gas from the boiler 1, steam or nitrogen. The coal discharged from the duct 6 need not be milled as fine and homogeneous as is required for the fuel fed to a pulverized coal burner thus allowing the system according to the invention to operate utilizing an extremely simple type of coal mill 9.

At the entry of the fuel from the duct 6 to the combustion chamber 3, the ratio of the mass flow rate of the pulverized coal to the carrier gas is greater or at least substantially equal to the upper ignition limit. The ratio of the mass flow rate of the pulverized coal to the carrier gas is adjusted to a desired value by means of controlling the rotational speeds of the screw conveyor 14 and the compressor 15. Advantageously, a 50–60% fraction of the pulverized coal has a particle size smaller than 74 $\mu$m. If the carrier gas is air and the fuel is pulverized coal with a coarse particle size of 70–150 $\mu$m, the ratio of the mass flow rate of the fuel to the carrier gas air is advantageously 1–10, most advantageously 3–7. The velocity of the pulverized coal and the carrier gas exiting from the duct 6 into the combustion chamber 3 is advantageously 20–30 m/s, most advantageously about 25 m/s. Secondary combustion air is admitted into the combustion chamber 3 at the level of the duct 6 or thereabove via secondary-air inlet means 7.

Figure 3:
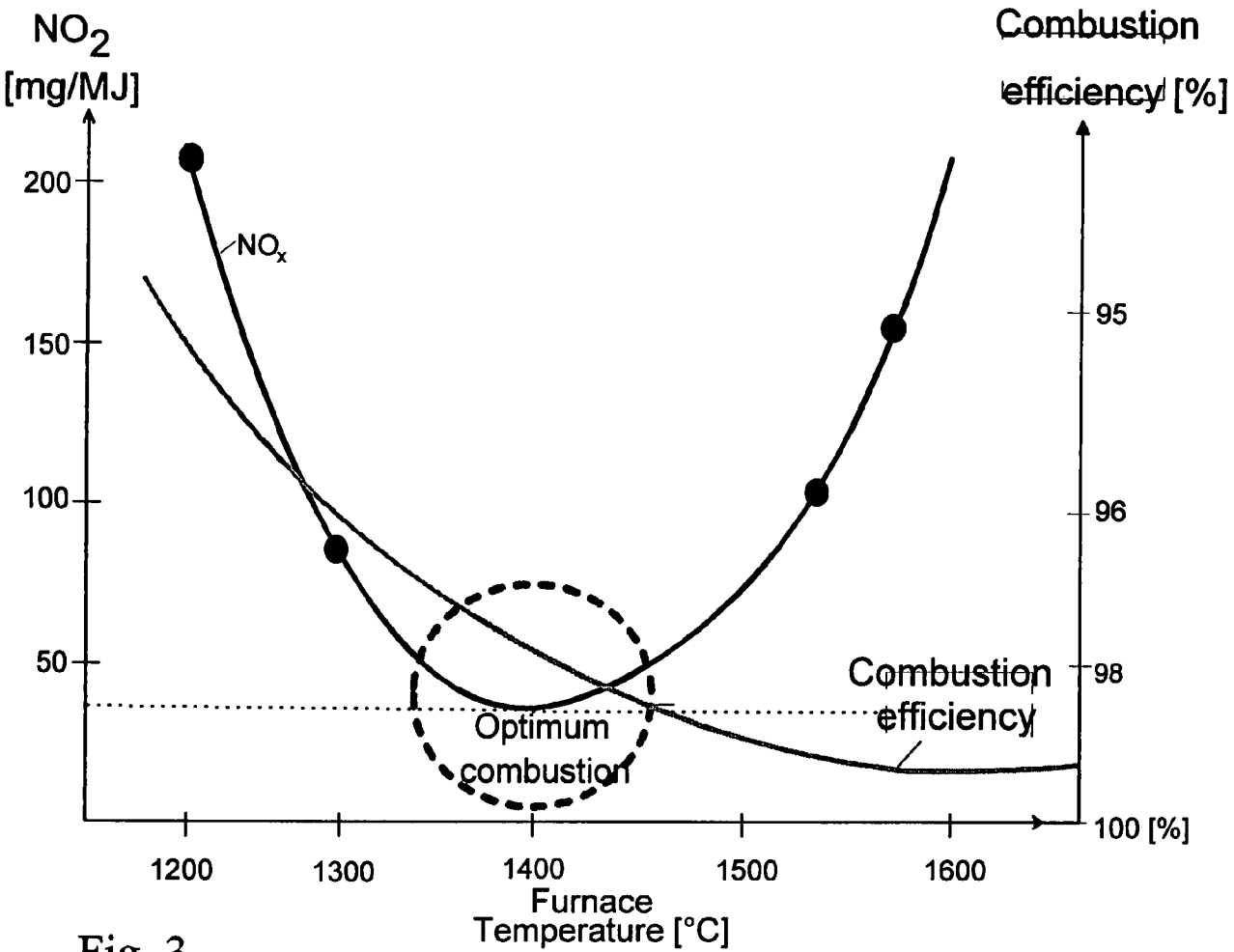
FIG. 3 is a diagram illustrating the amount of nitrogen oxide emissions and the combustion efficiency as a function of combustion temperature in the boiler.

The feed point of the mixture of the carrier gas and the pulverized coal is arranged depending on the size of the boiler 1 advantageously at a distance of 1 to 6 m, most advantageously 2 to 4 m, upward from the top level of the fluidized bed 2. The feed point can be adapted below the secondary-air inlet point 7 or at the same level with the secondary air inlet point 7. Typically, the height of the fluidized bed 2 is about 1 m, whereby the feed point of the carrier gas and the pulverized coal is about 2 to 7 m, most advantageously 3 to 5 m above the grid 13. The fluidizing air 4 dilutes the mixture fed from the duct 6 thus allowing the particles of the pulverized coal to ignite and burn under fuel-rich conditions at a high temperature above the fluidized bed 2. The ratio in this combustion process is typically 0.5 to 1 $kg_{coal}/kg_{air}$ and the combustion temperature is 1300 to 1500° C. The temperature is about 200 to 300° C. higher than the gas temperature in the freeboard above the fluidized bed of a conventional fluidized bed boiler. Thus, the temperature and other conditions in the space above the fluidized bed 2 are adjusted to an optimal range (cf. FIG. 3), whereby the formation of nitrogen oxides in combustion is minimized.

Advantageously, at least half, most advantageously 70 to 85%, of the pulverized coal fed via the duct 6 is combusted above the fluidized bed 2 and the rest descends into the bed 2 so as to undergo complete combustion in the bed 2. Resultingly, the temperature of the fluidized bed 2 rises slightly, which improves the combustion efficiency of the fuel fed from the first fuel feed means 5 into the fluidized bed 2. However, the temperature of the bed 2 does not herein rise excessively so that the bed material would begin to sinter. If the distance of the duct 6 from the top level of the fluidized bed 2 is made too small, a greater number of coal particles can fall into the fluidized bed 2, whereby the temperature of the fluidized bed 2 begins to rise. In contrast, if the distance of the duct 6 from the top level of the fluidized bed 2 is made too large, coal particles have enough time to burn down to a too small size before they reach the fluidized bed 2, whereby they are conveyed out from the combustion chamber 3 along with the flue gases, which is detrimental to the combustion efficiency of the boiler 1.

Due to the high temperature and low oxygen content, above the fluidized bed 2 is created a so-called reburn zone, wherein the hydrocarbon radicals stemming from the combustion of the fuel convert nitrogen oxides formed in the fluidized bed 2 into hydrogen cyanide. Simultaneously, dioxins and other organic compounds formed in the fluidized bed 2 from combustion of refuse fuel are destroyed.

To above the secondary-air inlet means 7, into the wall of the combustion chamber 3, are adapted tertiary-air inlet means 8 for injecting tertiary air into the combustion chamber 3. Herein, any uncombusted fuel still existing in the flue gas flow is combusted completely and hydrogen cyanide molecules formed in the reburn reaction are converted into molecular nitrogen. Fine coal particles, which are separated in the cyclone 10 from the flow of millded coal being transported to the coal storage 1, are fed along with the tertiary air into the combustion chamber 3, whereby the above-mentioned reburn reaction takes place also at the level of the tertiary air inlet means 8 as these fines are combusted. Calcium carbonate or limestone taken from a container 12 is mixed with the tertiary air 8 and the secondary air 7 in order to eliminate sulfur compounds from the effluents.

Conventionally a fraction of the total fuel power of the boiler 1 is fed as pulverized coal via the second set of fuel feed means 6, while the other fraction is fed in coarse-milled form via the first set of fuel feed means 5. The ratio of the fed fuel powers can be varied over a wide range. The first set of fuel feed means 5 and the second set of fuel feed means 6 may also be used independently from each other. Herein, the entire fuel power of the boiler 1 can be fed via the second set of fuel feed means 6, while the first set of fuel feed means 5 are closed, and vice versa. However, usually 10–90% of the total fuel power of the boiler 1 is fed to above the fluidised bed 2 via the second set of fuel feeding means 6.

Figure 2:
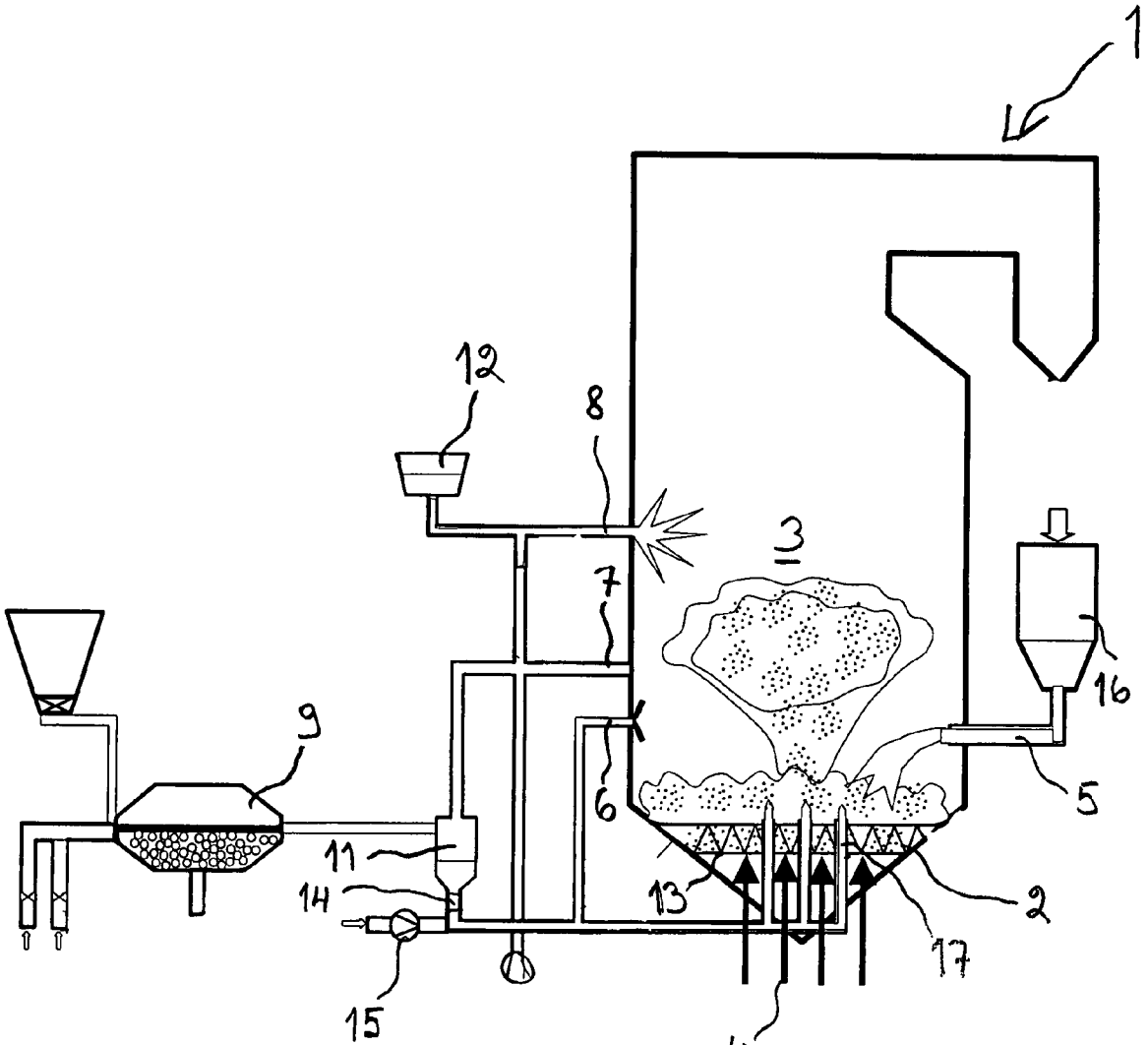
FIG. 2 is a schematic diagram of another embodiment of a combined fluidized bed and pulverized coal combustion system according to the invention.

The boiler 1 may also be operated as shown in FIG. 2, whereby the mixture of fuel and carrier gas normally passed to the second set of fuel feed means 6 is also discharged in to the combustion chamber 3 via nozzles 17 opening into the fluidized bed 2. Herein, the nozzles 17 perform as the first set of fuel feed means. A need to feed fuel via the nozzle 17 into the fluidized bed 2 arises, for instance, when the fuel supply from the silo 16 is insufficient or the silo 16 is entirely nonoperative. Then, the fuel discharged via the nozzle 17 serves as the preheating energy source of the fluidized bed 2.

The invention claimed is:

1. Combined fluidized bed and pulverized coal combustion method for use in the combustion chamber (3) of a fluidized bed boiler, the method comprising the steps of injecting fluidizing air (4) into a fluidized bed (2) situated in the bottom portion of the combustion chamber (3), feeding fuel from a first set of fuel feed means (5) into the fluidized bed (2) and combusting the fuel in the fluidized bed (2), feeding a mixture of pulverized coal and a carrier gas from a second set of fuel feed means (6) into the combustion chamber 3, to above the fluidized bed (2), into the combustion chamber (3), to above the fluidized bed (2) is fed the mixture of the pulverized coal and the carrier gas from the second set of fuel feed means (6) at a mass flow rate ratio which is higher or at least substantially equal to the upper ignition limit of the mixture, and the mixture of the pulverized coal and the carrier gas fed from the second set of fuel feed means (6) is diluted at least by the fluidizing air (4), characterized in that at least a fraction of the fuel fed via the second set of fuel feed means (6) is combusted above the fluidized bed (2) at the temperature of 1300 to 1500° C.

2. Method according to claim 1, characterized in that a fraction of the pulverized coal fed via the second set of fuel feed means (6) is combusted in the fluidized bed (2).

3. Method according to claim 1, characterized in that pulverized coal with air is fed via the second set of fuel feed means (6) so that the mass flow rate of these is from 1 to 10, most advantageously from 3 to 7.

4. Method according to claim 1, characterized in that secondary air (7) is injected into the combustion chamber (3), to above the second set of fuel feed means (6).

5. Method according to claim 1, characterized in that tertiary air (8) is injected into the combustion chamber (3), to above the level of the secondary-air inlet means (7).

6. Method according to claim 1, characterized in that into the combustion chamber (3) is fed via the second set of fuel feed (6) means the mixture of fuel and carrier gas at a velocity of 20 to 30 m/s, most advantageously at a velocity of about 25 m/s.

7. Method according to claim 1, characterized in that at least half, most advantageously 70 to 85%, of the pulverized coal fed via the second set of fuel feed means (6) is combusted above the fluidized bed (2).

8. Method according to claim 1, characterized in that into the combustion chamber (3) is fed via the second set of fuel feed means (6) the mixture of fuel and carrier gas at a level from 1 to 6 m, most advantageously from 2 to 4 m, above the top level of the fluidized bed (2).

9. Method according to claim 1, characterized in that the pulverized coal fed via the second set of fuel feed means (6) is combusted above the fluidized bed (2) at a ratio of 0.5 to 1 $kg_{coal}/kg_{air}$.

10. Combined fluidized bed and pulverized coal combustion system comprising a combustion chamber (3) with an grid (13) adapted to the bottom portion thereof, a fluidized bed (2) adapted to the bottom portion of the combustion chamber (3) and formed by a particulate matter bed material, air injection means adapted to the grid (13) for feeding fluidizing air (44) into the bed material, a first set of fuel feed means (5) for feeding fuel into the fluidized bed (2), the system comprises a second set of fuel feed means (6) for feeding a mixture of pulverized coal and a carrier gas into the combustion chamber (3), at a distance above the fluidized bed (2) at a mass flow rate ratio which is higher or at least substantially equal to the upper ignition limit of the mixture, and the second set of fuel feed means (6) are adapted at a distance above the top level of the fluidized bed such that the mixture of pulverized coal and a carrier gas discharged from said means becomes dilutable with the fluidizing air (4) and at least in partially combustible above the fluidized bed (2)

characterized in that the second set of fuel feed means (6) are arranged at such a distance above the top level of the fluidized bed that the combustion temperature of the pulverized coal above the bed is 1300–1500° C.

11. System according to claim 10, characterized by means (7) for injecting secondary air into the combustion chamber (3) at a level above said second set of fuel feed means (6).

12. System for fluidized bed combustion according to claim 10, characterized by means (8) for injecting tertiary air into the combustion chamber (3) at a level above said secondary-air inlet means (7).

13. System according to claim 10, characterized in that said second set of fuel feed means comprise at least one duct (6) exiting into the combustion chamber (3).

14. System according to claim 10, characterized in that at least half, most advantageously 70 to 85% of the pulverized coal fed via the second set of fuel feed means (6) is combustible above the fluidized bed (2).

15. Method according to claim 2, characterized in that pulverized coal with air is fed via the second set of fuel feed means (6) so that the mass flow rate of these is from 1 to 10, most advantageously from 3 to 7.

16. Method according to claim 4, characterized in that tertiary air (8) is injected into the combustion chamber (3), to above the level of the secondary-air inlet means (7).

17. Method according to claim 7, characterized in that the pulverized coal fed via the second set of fuel feed means (6) is combusted above the fluidized bed (2) at a ratio of 0.5 to $kg_{coal}/kg_{air}$.

18. System for fluidized bed combustion according to aim 11, characterized by means (8) for injecting tertiary air to the combustion chamber (3) at a level above said secondary-air inlet means (7).

* * * * *